US006095077A

United States Patent [19]

DeAgro

[11] Patent Number: 6,095,077

[45] **Date of Patent: *Aug. 1, 2000**

[54] APPARATUS FOR MOTORIZED BOAT ATTITUDE ADJUSTMENT

[76] Inventor: John E DeAgro, 4196 Racquet Club Dr., Huntington Beach, Calif. 92649

[ * ] Notice: This patent issued on a continued prosecution application filed under 37 CFR 1.53(d), and is subject to the twenty year patent term provisions of 35 U.S.C. 154(a)(2).

[21] Appl. No.: 08/949,071

[22] Filed: Oct. 10, 1997

[51] Int. Cl.[7] ..... B63B 1/22

[52] U.S. Cl. ..... 114/285; 114/286

[58] Field of Search ..... 114/284–287; 267/113, 124, 118

[56] References Cited

U.S. PATENT DOCUMENTS

| | | | |
|---|---|---|---|
| 3,177,837 | 4/1965 | Sherrill | 114/286 |
| 3,200,782 | 8/1965 | Walden et al. | 114/285 |
| 3,568,618 | 3/1971 | Bedford | 114/66.5 |
| 3,577,948 | 5/1971 | Frey | 114/286 |
| 4,548,389 | 10/1985 | Smith et al. | 267/64.11 |
| 4,854,259 | 8/1989 | Cluett | 114/285 |

*Primary Examiner*—Sherman Basinger

*Attorney, Agent, or Firm*—Stetina Brunda Garred & Brucker

[57] ABSTRACT

A trim tab for a boat, which includes a plate, adapted for pivotal mounting to the boat transom, the plate having a lower surface for water impact and an upper surface for attachment of a spring; and a gas-dampened spring, having a longitudinal axis, a first end and a second end, wherein the first end is adapted for fixed attachment to the transom of the boat, and the second end is fixedly attached to the upper surface of the plate.

6 Claims, 4 Drawing Sheets

APPARATUS FOR MOTORIZED BOAT ATTITUDE ADJUSTMENT

FIELD OF THE INVENTION

This invention relates generally to an apparatus for attitude adjustment of motorized boats. More particularly it relates to an apparatus for automatic attitude adjustment of motorized boats in accordance with changing conditions of the boat moving through water.

BACKGROUND OF THE INVENTION

It is commonly known that the position or attitude of a boat in the water impacts the boat's performance. If the front or bow of the boat is riding too high or too low more power is required to propel the boat than if the boat were positioned in the water more horizontally or level, with relation to the plane of the water. There exists an attitude angle or level plane that provides an optimal function and economy for the moving vessel. This optimal attitude varies with the speed of the boat. When the boat is traveling at a desirable level or attitude in the water it is often referred to as being "on plane" and when the boat is not in the desirable level plane or attitude angle, it is referred to as being "off plane."

Each different exterior or hull design will go on plane at a different and particular speed, specific to that hull. When the boat slows down it will go off-plane at a slightly lower speed than the speed it went on plane. There is always an "off-plane to on-plane" speed and a slightly slower "on-plane to off-plane" speed.

The adjustments that are made to obtain this proper attitude of the moving boat are often referred to as trimming the boat. A trim tab or plate is one type of device used to accomplish the trimming of the boat to the desired level plane. Most often a pair of trim tabs are utilized and positioned typically to the left and right of center on the transom of the boats.

Trim tabs typically are hinged, pivoting, planar surfaces that are mounted at the back of a motor-powered boat, on the transom of the boat. Trim tabs are mounted to the transom at the water level, for water engagement with their planar surface.

Trim tabs are positioned, relative to the hull, and relative to the transom of the boat on which they are mounted. Trim tabs are variable in position so as to change the attitude of the hull of a moving boat in response to the speed of the boat to obtain the desired level plane. Trim tabs typically pivot about a horizontal axis such that their planar surfaces are either raised or lowered to engage the moving water in different ways.

Trim tabs provide several useful functions as a result of being able to change the attitude of a moving boat's hull. These include such things as increased speed, improved economy of fuel consumption and engine efficiency, as well as, improved forward visibility. Additionally trim tabs allow adjustment of the boat's attitude to a more level position that is safer or more comfortable to the boat's occupants, and a reduced time and energy requirement for the boat to get on plane.

In most cases, adjustment of the trim tabs is assisted or accomplished by electrical or hydraulic power or a combination of the two. Trim tabs are controlled in the typical case by a pair of switches, one for each trim tab.

On small to moderate size vessels, typically 9 to 20 feet, manually operated or fixed position trim tabs have been effective in setting the planing angle. The problems encountered in the trimming process are significant due to constantly changing conditions. Automatic trimming is desirable because of the constantly changing conditions which affect the trim or attitude of the boat, such as, changes in load, speed and sea conditions.

While trim tabs are widely used and significantly contribute to proper control of power-boat attitudes as they move over the water, a number of shortcomings and problems are present in trim-tab systems of the prior art.

One problem is when the operator has no knowledge or insufficient knowledge of the positions of the trim tabs or the rate of their movement during adjustment. The trim tabs should be positioned differently during different operational conditions and uses of the boat. It can be difficult for many boat users to adjust the tabs for optimal performance.

Small vessels, often don't have room, design or electricity necessary to accommodate hydraulic/electric systems for automatic trimming. Small boats have either foregone the use and advantages of trimming devices or have used fixed trim tabs which have further undesirable characteristics. One example being, once boat is up on plane, then the fixed position of the trim tabs creates drag, which defeats their purpose.

There is still a need for automatic attitude adjustment of powered boats underway.

SUMMARY OF THE INVENTION

The present invention is directed to an apparatus for motorized boat attitude adjustment. The invention is a trim tab for a boat, comprising a plate adapted for pivotal mounting to the boat transom, said plate having a lower surface for water impact and an upper surface for attachment of a spring; and a gas-dampened spring, having a longitudinal axis, a first end and a second end, wherein the first end is adapted for fixed attachment to the transom of the boat, and the second end is fixedly attached to the upper surface of the plate.

Additional advantages and novel features of the invention will be set forth in part in the description that follows, and in part will become apparent to those skilled in the art upon examination of the following or may be learned by practice of the invention. The advantages of the invention may be realized and attained by means of the instrumentalities and combinations particularly pointed out in the appended claims.

DETAILED DESCRIPTION

Figure 1:
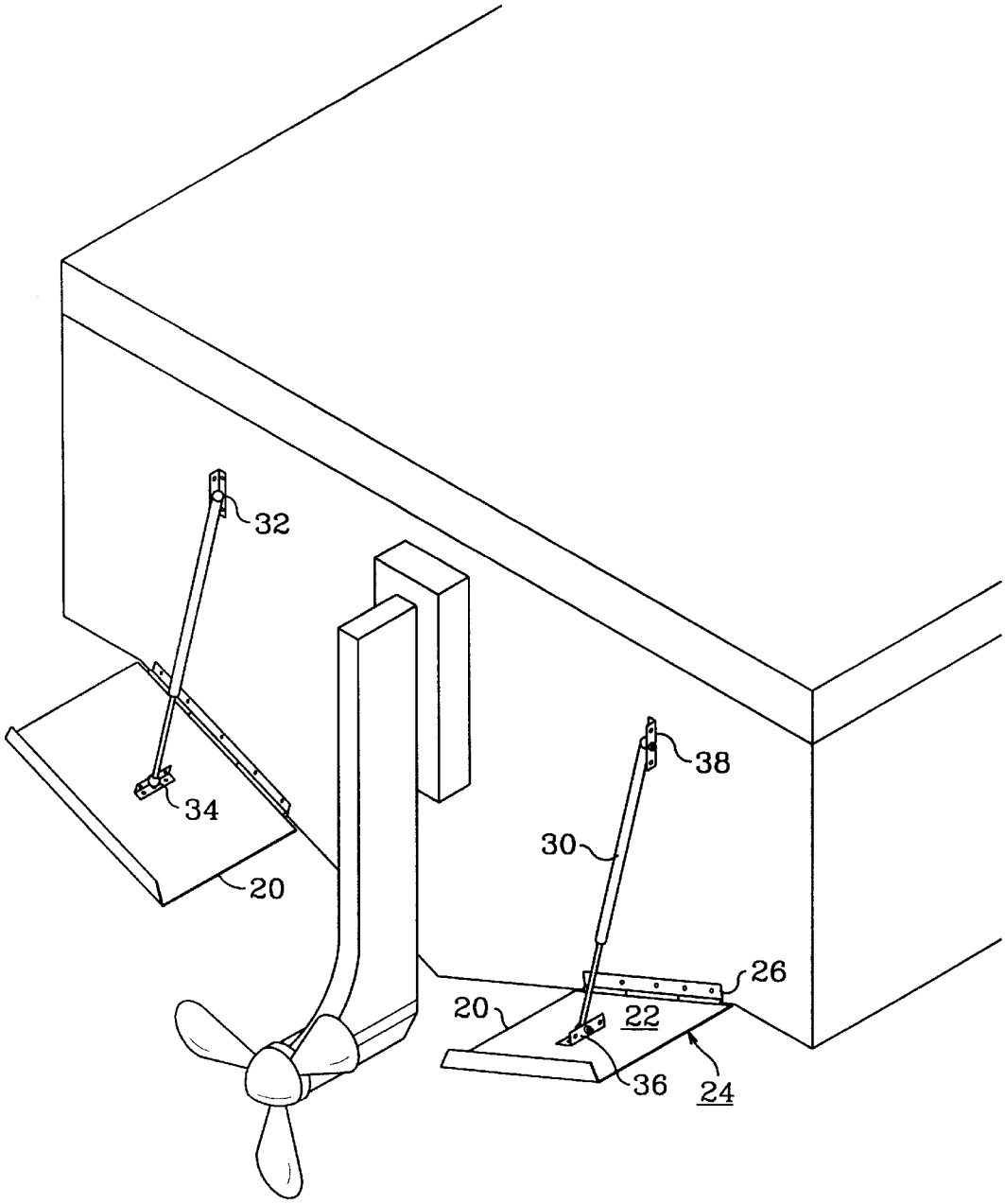
FIG. 1 is a schematic environmental view, showing the described invention attached to a boat.
Figure 2:
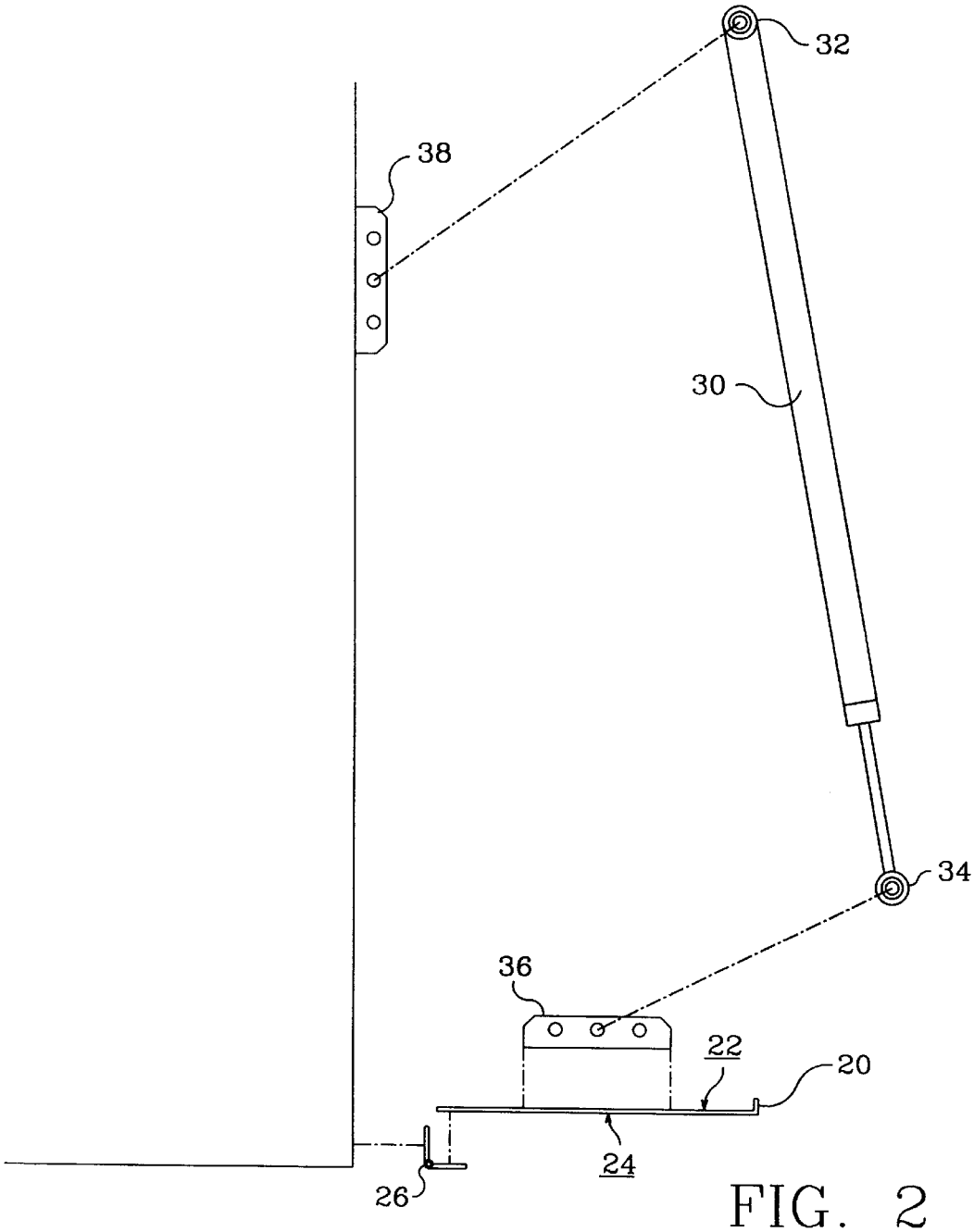
FIG. 2 is a schematic exploded assembly view of the invention.
Figure 3:
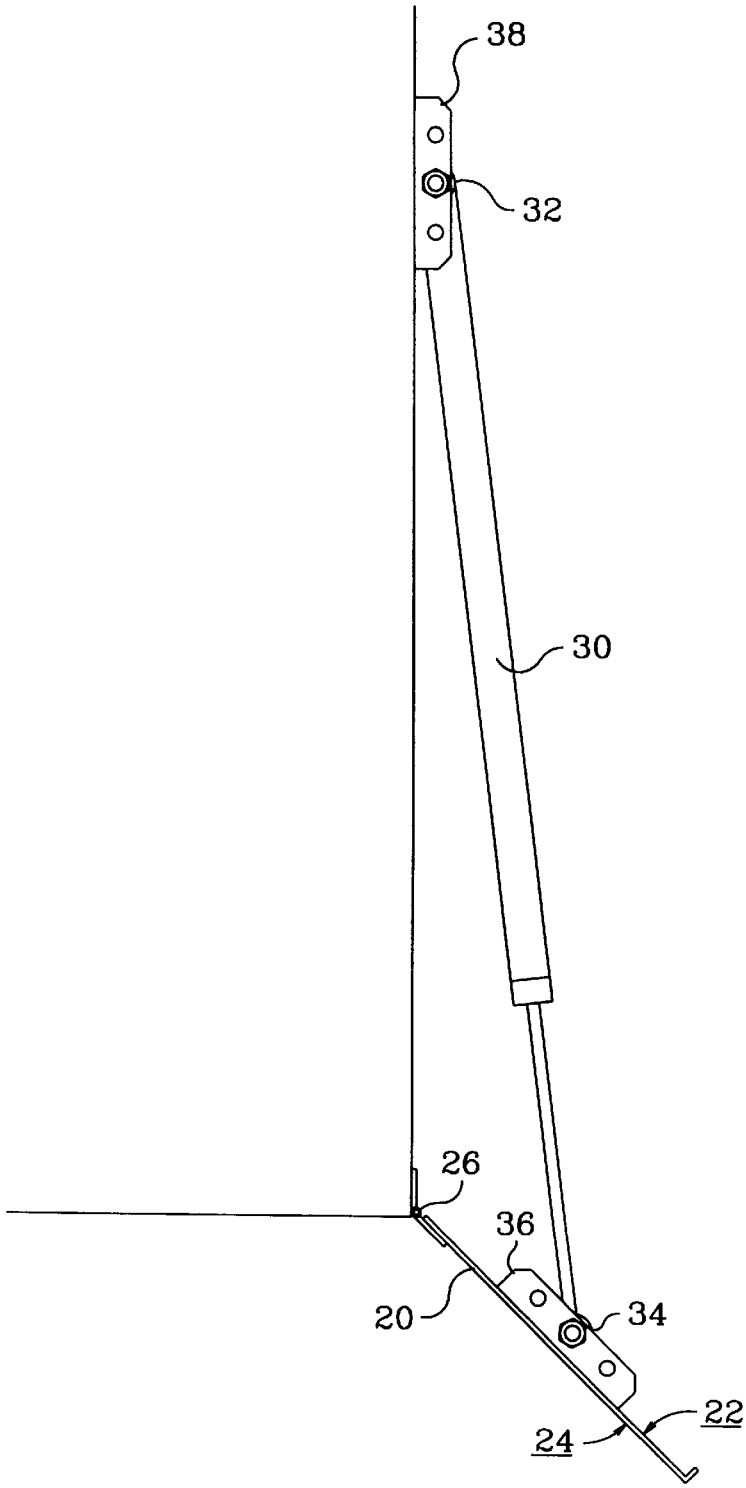
FIG. 3 is a is a side view of the invention showing the gas dampened in the extended position.
Figure 4:
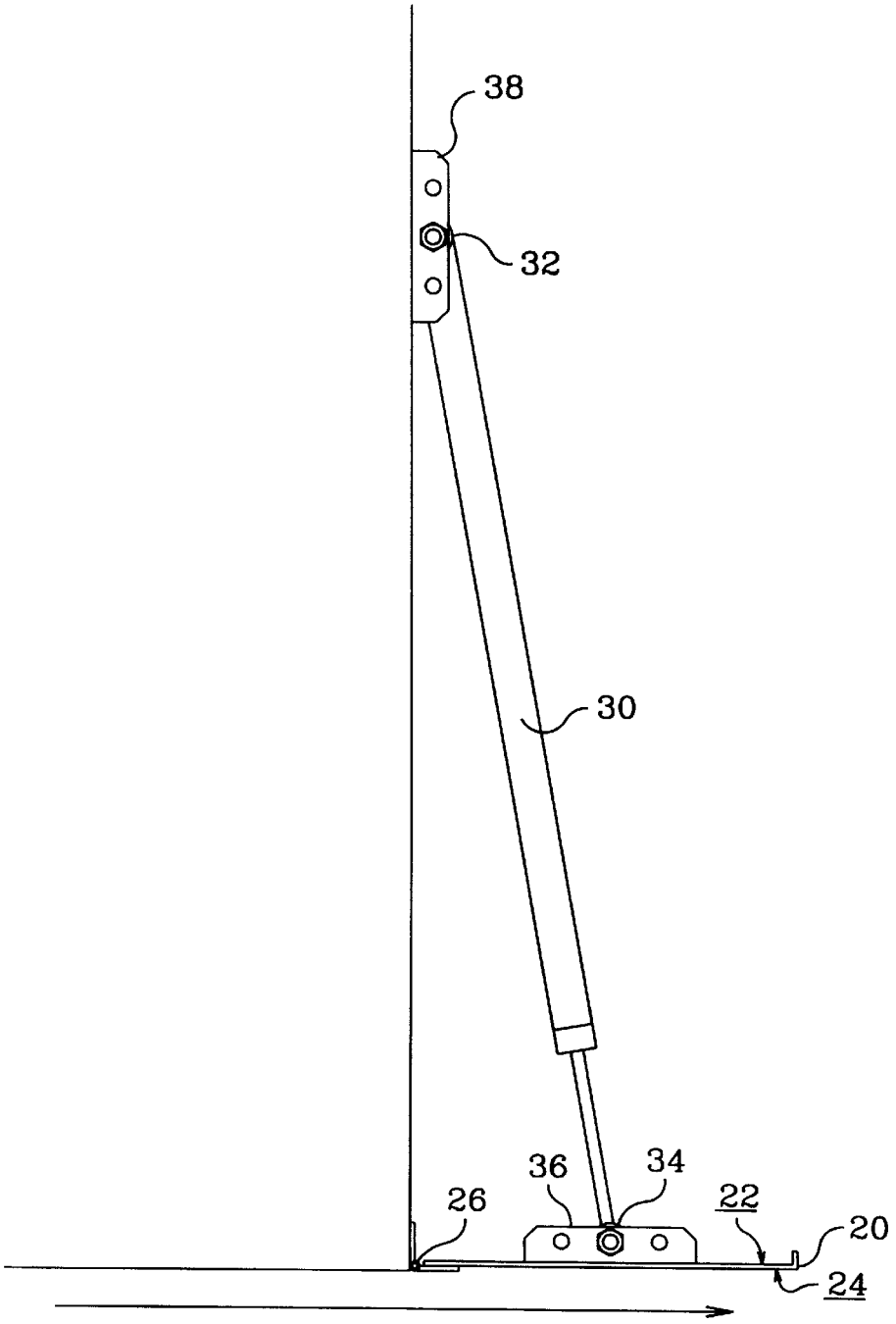
FIG. 4 is a is a side view of the invention showing the gas dampened in the retracted position.

The present invention is in general terms, an apparatus for automatic attitude adjustment of motorized boats.

Referring to the figures, an exemplary embodiment of the present invention is described herein. Trim tab 10 comprises plate 20, and gas dampened spring 30.

Plate 20 is substantially planar and has an upper surface 22 and lower surface 24. Plate 20 is adapted for pivotal mounting to a boat transom. Here plate 20 is attached to hinge 28 and hinge 28 is further mounted to the transom of the boat. Plate 20 is attached to hinge 28 by a plurality of screws. In this example, plate 20 is substantially planar with a turned edge 26 or small upward deflection of the planar surface edge furthermost from the boat transom. Other suitable shapes for plate 20 may also be used, for example, plate 20 may be parabolic or curved in shape. It is contemplated that plate 20 may be of other suitable construction that allows pivotal mounting to the boat transom. For example, plate 20 can be of integral or unitary construction with a pivotal section suitable for mounting to the boat transom. Likewise, plate 20 may be attached to a pivotal assembly, such as hinge 28 and attached to the boat transom by other suitable means in addition to screw-mounting. For example, plate 20 can be mounted to a hinge and/or the boat transom by use of a suitable adhesive, soldering, riveting, stapling, and the like.

Gas dampened spring 30 has a longitudinal axis, a first end 32, and a second end 34, wherein first end 32 is adapted for fixed attachment to the transom of the boat, and second end 34 is fixedly attached to the upper surface of plate 20. In the described embodiment second end 34 of gas spring 30 is adapted for fixed attachment to upper surface 22 of plate 20 by trim plate mounting bracket 36. Also in the present embodiment, trim plate mounting bracket 36 is constructed to provide a variety of mounting angles or positions for the fixed attachment of gas spring 30 to upper surface 22 of plate 20. The variety of mounting positions allow gas spring 30 to be optionally attached closer to the transom of the boat, which serves as a pivot point, causing a variance in the amount of water pressure required to compress gas spring 30. Smaller or lighter boats will tend to use a position close to the transom pivot point, and larger boats will tend to use a position further from the transom pivot point. The more water pressure required to compress gas spring 30, the more lift provided to the aft end of the boat.

Second end 34 of gas spring 30 is fixedly attached to upper surface 22 of plate 20 by plate mounting bracket 36 via a plurality of screws. It is also contemplated that the fixed attachment of second end 34 of spring 30 to upper surface 22 of plate 20 may be accomplished in any suitable manner. For example, second end 34 of spring 30 may be manufactured integrally with upper surface 22 of plate 20, or second end 34 may be fixedly attached by other suitable means, including but not limited to, adhesive, solder, rivets, staples and the like.

First end 32 of gas spring 30 is, in this described embodiment, adapted for fixed attachment to the transom of a boat by use of transom bracket 38. Similar to plate bracket 36, transom bracket 38 is constructed to provide a variety of mounting angles or positions. The variety of mounting positions allows for adjusting down an initial angle for plate 20, here desirably between 30° and 45°. Depending on the power capability of the boat and the lift required to bring the boat to a planing attitude under power, gas spring 30 will be optionally mounted closer to the pivot point of plate hinge 28, or further away. Closer to plate hinge 28 increases the initial angle and further from plate hinge 28 reduces the initial angle.

First end 32 is attached to the boat transom by transom bracket 38, through the employment of a plurality of screws. It is contemplated that first end 32 of gas spring 30 can be adapted in a variety of suitable means for fixed attachment to the transom of a boat. For example first end 32 may be manufactured with any desired integral fitting thereon, or manufactured for captive mating with any desired mounting assembly.

Gas dampened spring 30 is most desirably a gas filled and internally valved spring. An example of a suitable spring is a 12 inch spring, such as part number GS-515020, manufactured by Service Plus Distributors, Inc. (Besalem, Pa.). The size of gas spring 30 would vary according to the size of boat used and expected use of the boat. For example, for an approximately 9 to 12 foot boat, a 20 pound load capacity spring would be appropriate. A larger boat would generally require a larger capacity gas spring 30, that would be of an appropriate size and length to support the particular load capacity.

The use of the invention, as described in this illustrative embodiment, includes the steps and structures necessary for understanding and explaining the invention and it's use. Other typical steps and structures that are normally related to the use of the invention and well known to one skilled in the art, but that are not essential to the understanding of the present invention, are not described in detail herein, to avoid confusion.

In use, plate mounting bracket 36 and transom bracket 38 are positioned so that gas spring 30, when normally extended, holds trim plate 20 below the bottom edge of the transom. In the present embodiment the angle below the bottom of the boat, from a position which is parallel to the bottom of the boat hull is between 30° and 45°.

When the boat moves forward, under power, the water will create an upward pressure on trim plate 20. When the boat speed increases the water pressure will create a lifting action on the aft end of the boat. This will allow the boat to achieve a more level attitude or plane at speeds slower than possible without trim tab 10.

Gas spring 30 is designed to compress at a predetermined pressure or load. As the boat speed increases the water pressure begins to exceed the pressure or load capacity of gas spring 30, at which point gas spring 30 compresses and allows trim plate 20 to move upward into a more horizontal position with the bottom of the boat hull. As the boat continues to increase speed trim plate 20 will eventually become parallel to the bottom of the boat.

The reverse occurs when the boat speed decreases. Gas spring 30 reacts to the water pressure and will push trim plate 20 down at the slower speeds, until there is not enough water pressure to overcome the spring load capacity.

Since trim plate 20 reacts to the water pressure, plate 20 automatically and continuously adjusts to the maximum available lift, and therefore keeps the boat as level and on plane as possible. The size of trim plate 20, the load capacity of gas spring 30 and the boat speed or resulting water force will determine the amount of lift capability.

The trim tab of the present invention permits the automatic trimming or attitude adjustment of a boat. The invention allows the automatic attitude adjustment without the need for electronic and hydraulic adjustment devices that are typically required to accomplish the above. This advantageously allows this invention to be used on water crafts that do not have the space and/or complexity to accommodate wiring or electricity. This invention is particularly suitable for smaller boats. The present invention provides an elegantly simple device for accomplishing automatic attitude adjustment of a boat under way.

The invention has been described in the environment of a single trim tab attached to the transom of a boat. This environment was chosen for illustration purposes only, to further the understanding of the invention. It will be apparent to one skilled in the relevant art that most typically the invention is used in pairs, appropriately space apart in their mounting on the transom of the boat. Likewise, it will be apparent to one skilled in the relevant art that the invention has application to any type of powered water craft. For example the invention can be used with inflatable crafts and attached to an appropriate surface that functions as a transom equivalent.

It will therefore be understood that modifications and variations are possible without departing from the scope of the invention as expressed in the following claims.

I claim:

1. A trim tab for a boat, comprising:

a plate adapted for pivotal mounting to the boat transom, said plate having a lower surface for water impact and an upper surface for attachment of a spring; and a gas-dampened internally valved spring, the gas flowing through the valve as the plate pivots, the spring having a longitudinal axis, a first end and a second end, wherein the first end is adapted for pivotal attachment to the transom of the boat, and the second end is pivotally attached to the upper surface of the plate;

wherein the gas-dampened spring comprises a self-contained source of gas in a fixed quantity; and wherein the gas dampened, internally valved spring dampens pivoting of the plate in response to transient forces acting on the plate.

2. The trim tab of claim 1 wherein the plate is a substantially planar and rectangular shape.

3. The trim tab of claim 1 wherein the plate has a turned edge.

4. The trim tab of claim 1 wherein the pivotal attachment of the first end of the gas dampened spring to the transom of the boat is adjustable.

5. The trim tab of claim 1 wherein the pivotal attachment of the second end of the gas dampened spring to the upper surface of the plate is adjustable.

6. A boat having a transom and at least one trim tab, the trim tab comprising:

a plate adapted for pivotal mounting to the boat transom, said plate having a lower surface for water impact and an upper surface for attachment of a spring; and a gas-dampened, internally valved spring, the gas flowing through the valve as the plate pivots, the spring having a longitudinal axis, a first end and a second end, wherein the first end is adapted for pivotal attachment to the transom of the boat, and the second end is pivotably attached to the upper surface of the plate;

wherein the gas-dampened spring is self-adjusting and further comprises a self-contained source of gas in a fixed quantity and;

wherein the was dampened, internally valved spring dampens pivoting of the plate in response to transient forces acting on the plate.

* * * * *